US007909197B2

(12) United States Patent
Mikkelsen

(10) Patent No.: US 7,909,197 B2
(45) Date of Patent: Mar. 22, 2011

(54) HIGH VOLUME DOCKING SEAL FOR BULK LIQUID DISPENSING CARTRIDGE

(75) Inventor: Douglas Lynn Mikkelsen, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 716 days.

(21) Appl. No.: 11/744,931

(22) Filed: May 7, 2007

(65) Prior Publication Data

US 2008/0277370 A1 Nov. 13, 2008

(51) Int. Cl.
*B65D 41/04* (2006.01)
*B65D 53/04* (2006.01)

(52) U.S. Cl. ..... 220/295; 215/349

(58) Field of Classification Search ..... 220/288, 220/200, DIG. 19, FOR. 111, FOR. 110, 220/FOR. 109, FOR. 105, FOR. 102, 295, 220/806, 804, 803, 802, 801, 796; 215/349, 215/310, 200, 211, 201, 344, 363, 355, 342, 215/341, 316, 217, 45, 44, 43; D9/437, 436, D9/435; 277/648, 651, 649, 628
See application file for complete search history.

(56) References Cited

U.S. PATENT DOCUMENTS

| | | | | | |
|---|---|---|---|---|---|
| 497,896 | A | * | 5/1893 | Ruppel | 137/454 |
| 1,241,352 | A | | 9/1917 | Doering et al. | |
| 1,672,055 | A | * | 6/1928 | Carpmael | 215/294 |
| 2,777,125 | A | * | 1/1957 | Weisse | 220/231 |
| 3,064,844 | A | * | 11/1962 | Hoffmann | 215/45 |
| 3,088,615 | A | * | 5/1963 | Wheaton et al. | 215/249 |
| 3,612,320 | A | * | 10/1971 | Wassilieff | 215/316 |
| 3,792,794 | A | * | 2/1974 | Cutter et al. | 215/247 |
| RE27,975 | E | * | 4/1974 | Bergmann et al. | 336/92 |
| 3,923,179 | A | * | 12/1975 | Choksi et al. | 215/203 |
| 4,434,909 | A | * | 3/1984 | Ott | 220/316 |
| 4,487,326 | A | * | 12/1984 | Uhlig | 215/307 |
| 5,280,764 | A | | 1/1994 | Levinrad | |
| 5,337,922 | A | | 8/1994 | Salkeld et al. | |
| 5,346,083 | A | * | 9/1994 | Song et al. | 215/341 |
| 5,370,270 | A | * | 12/1994 | Adams et al. | 222/88 |
| 5,850,640 | A | * | 12/1998 | Pinciaro | 4/541.6 |
| 6,006,388 | A | | 12/1999 | Young | |
| 6,029,860 | A | * | 2/2000 | Donselman et al. | 222/185.1 |
| 6,167,921 | B1 | | 1/2001 | Busick et al. | |
| 6,878,481 | B2 | * | 4/2005 | Bushong et al. | 429/54 |
| 7,021,494 | B2 | | 4/2006 | Mazooji et al. | |
| 7,086,430 | B2 | | 8/2006 | Walton | |
| 2006/0081016 | A1 | | 4/2006 | Hsu et al. | |

* cited by examiner

*Primary Examiner* — Anthony Stashick
*Assistant Examiner* — Robert J Hicks
(74) *Attorney, Agent, or Firm* — Clifton G. Green; Greer, Burns & Crain Ltd

(57) ABSTRACT

A seal member for a dispensing cartridge includes a flat circular seal disk, a frustoconical wall extending outwardly away from the seal disk, and a ring at an open end of the frustoconical wall. The seal member is assembled with a cap having an end wall and a cylindrical skirt wall. The skirt wall has an internal diameter and the ring has a slightly smaller outer diameter. The ring abuts the end wall. A central opening extends through the end wall with a diameter no larger than a ring inner diameter. The dispensing cartridge has a cylindrical mouth wall with inner and outer diameters. The skirt wall has an internal diameter sized to receive the mouth wall outer diameter and the diameter of the seal disk is larger than the mouth wall inner diameter. The ring outer diameter is at least equal to the mouth wall outer diameter.

20 Claims, 3 Drawing Sheets

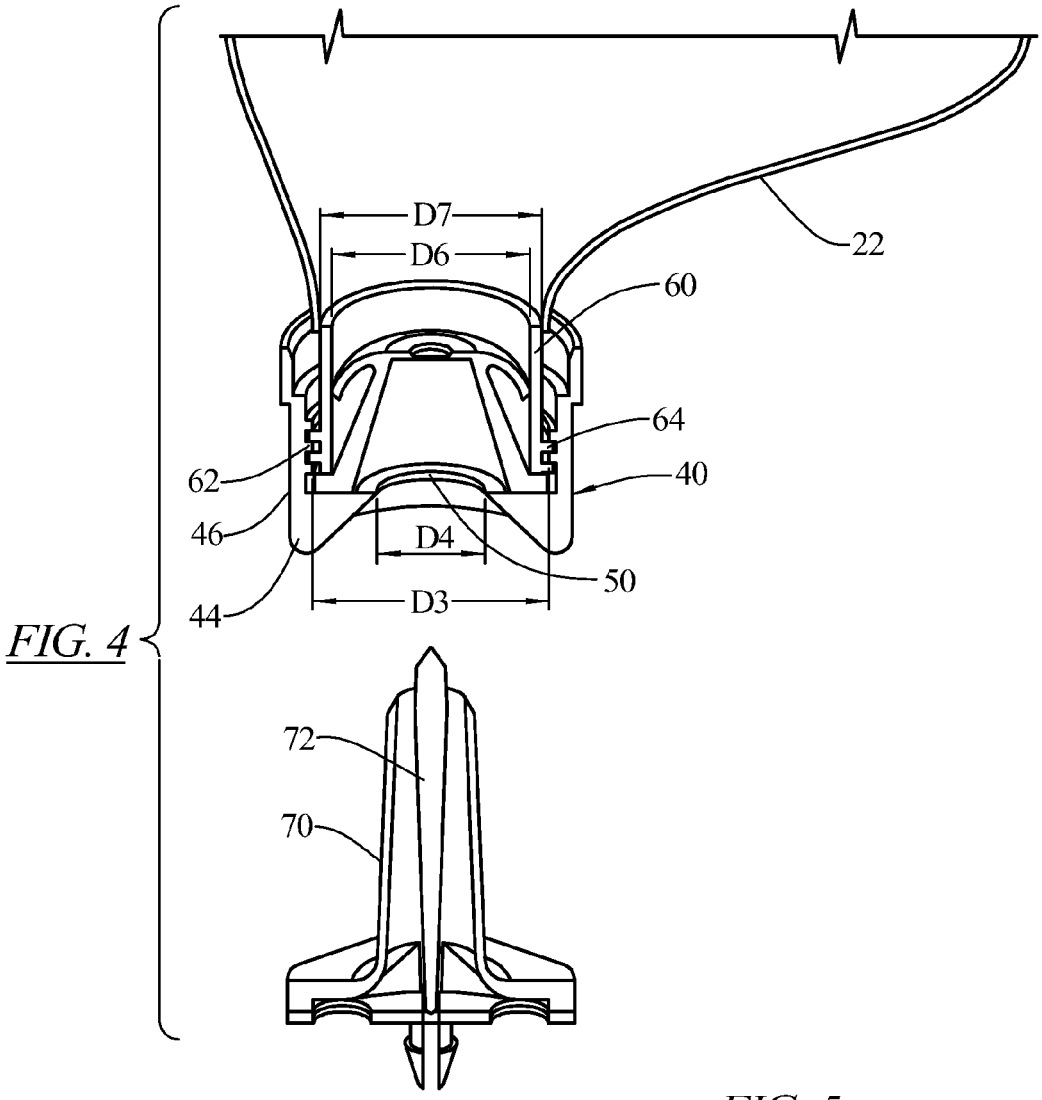
FIG. 4
FIG. 5
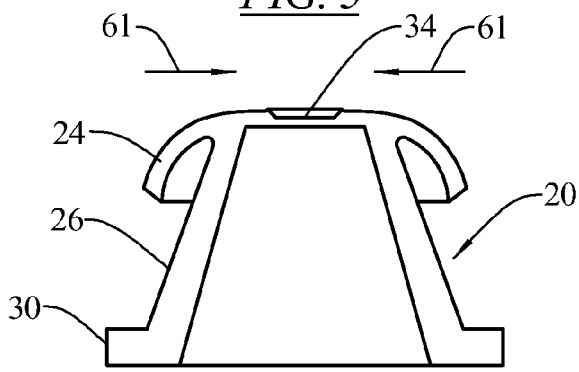

HIGH VOLUME DOCKING SEAL FOR BULK LIQUID DISPENSING CARTRIDGE

BACKGROUND OF THE INVENTION

In substrate treating appliances, such as laundry appliances, oftentimes different chemistries are added to the appliance during different treatment cycles or at different times during a given treatment cycle, depending on the treatment function to be performed, and depending on the item being treated, for example. It is known to provide different containers containing different chemistries, such that during operation of the appliance, the appropriate chemistries can be selected and introduced to the appliance. U.S. Published application 2006/0081016 discloses an automatic washer with several different containers with different chemistries to be dosed to the washer.

Dispensing high volumes of liquid from a cartridge or bottle into an automated appliance requires a docking system to join the two together. The industry standard seals presently used to prevent liquids from leaking into the surrounding environment when the two mechanisms are joined are meant for low volume transfer. These low volume docking mechanisms use a small diameter hollow needle to puncture through a soft membrane seal attached to the orifice of the bottle. When the small needle is removed, the soft membrane self-heals itself to prevent the liquid from leaking out of the bottle. When a large diameter needle is used to transfer high volumes of liquid quickly, the standard membrane seal cannot self-heal when the needle is removed because the membrane material is ripped beyond its capacity for its natural "plastic memory" to return to its static state before being punctured. For example, U.S. Pat. No. 6,006,388 discloses a docking system for a bottle in which a transfer needle punctures a frangible membrane which will not thereafter reseal.

Therefore some type of mechanical mechanism must be used to force the large hole in the membrane closed.

It would be an improvement in the art if there were provided an arrangement for assuring that the chemistry cartridges have seal members that effectively reseal themselves even when high volume needles are used to puncture the seals.

SUMMARY OF THE INVENTION

In an embodiment, the present invention provides a seal member for a bulk liquid dispensing cartridge. The seal member includes a flat circular seal disk, a frustoconical wall extending away and outwardly from an intermediate portion of the seal disk, and a ring positioned at an open end of the frustoconical wall.

In an embodiment, the seal disk has a central area with a reduced thickness as compared to a remainder of the seal disk.

In an embodiment, the ring has a larger outer diameter than a diameter of the seal disk.

In an embodiment, the seal is integrally formed as one piece of a pliable material having a plastic memory.

In an embodiment, the ring extends radially outwardly of the free end of the frustoconical wall.

In an embodiment of the invention, the seal member is assembled with a cap. The assembly includes the seal member as described above and a cap having an end wall and a depending cylindrical skirt wall. The cylindrical skirt wall has an internal diameter, and the ring of the seal member has an outer diameter slightly less than the internal diameter of the skirt wall. The ring is positioned in an abutting relationship with an interior surface of the end wall of the cap. The cap has a central opening through the end wall with a diameter no larger than an inner diameter of the ring.

In an embodiment, the central opening through the end wall of the cap is beveled.

In an embodiment of the invention, the cap and seal member assembly is for use with a bulk liquid dispensing cartridge having a cylindrical mouth wall with an inner diameter and an outer diameter. The cap and the seal member are constructed as described above, further including that the internal diameter of the cylindrical skirt wall of the cap is sized to receive the outer diameter of the cartridge mouth wall and the diameter of the seal disk is larger than the inner diameter of the cartridge mouth wall. The ring on the seal member has an outer diameter less than the internal diameter of the skirt wall and at least equal to the outer diameter of the cartridge mouth wall.

In an embodiment, the cap includes a helical thread to engage with a complementary helical thread on the cylindrical mouth wall of the cartridge.

BRIEF DESCRIPTION OF THE DRAWING

FIG. 4 is a perspective side sectional view of the seal member and cap assembly on a cartridge with the seal member intact.

FIG. 5 is an isolated side sectional view of the seal member in the condition of FIG. 4.

DETAILED DESCRIPTION OF THE PREFERRED EMBODIMENTS

Figure 1:
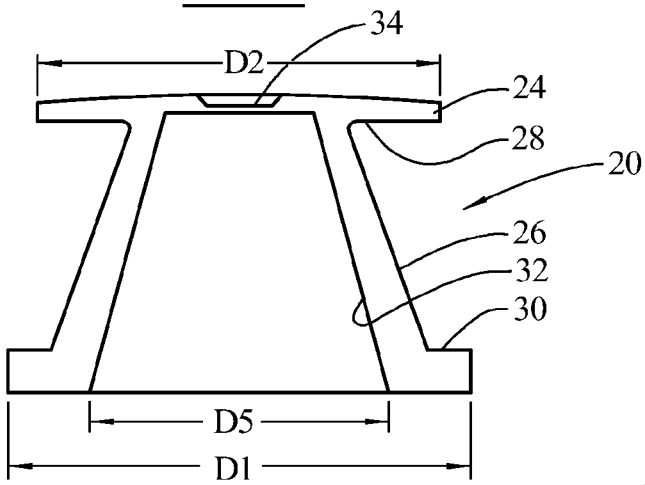
FIG. 1 is a side sectional view of a seal member embodying the principles of the present invention.
Figure 7:
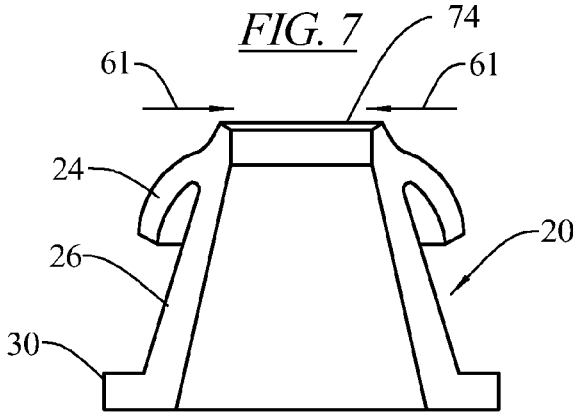
FIG. 7 is an isolated side sectional view of the seal member in the condition of FIG. 6.

In an embodiment, as shown in FIG. 1, the present invention provides a seal member 20 for a bulk liquid dispensing cartridge 22 (FIG. 4). The seal member 20, which is shown in isolation in FIGS. 1, 5 and 7, includes a flat circular seal disk 24, a frustoconical side wall 26 extending away (axially) and outwardly (radially) from an intermediate portion 28 of the seal disk (the smaller end of the wall is located at the seal disk), and a ring 30 positioned at an open end 32 of the frustoconical wall.

In the embodiment illustrated, the seal disk 24 has a central area 34 which has a reduced thickness as compared to a remainder of the seal disk. In use, as discussed below, this central area 34 will be punctured (FIG. 6), and the reduced thickness assists in the puncturing action. In other embodiments, the thinning of the central area 34 may not be necessary.

Also in the embodiment illustrated, the ring 30 has a larger outer diameter D1 than a diameter D2 of the seal disk 24. In other embodiments, the diameter D2 of the seal disk 24 may be equal to or larger than the outer diameter D1 of the ring 30.

In the embodiment illustrated, the seal member 20 is integrally formed as one piece of a pliable material having a plastic memory. For example, the seal member 20 may be molded of a plastic material preferably elastomers of various durometers and more preferably silicones of various durometers. In other embodiments, the seal member 20 may be fabricated in separate parts which are later secured together, such as with adhesives or plastic welding. In such an embodiment, the ring 30 may be fabricated of a material different than the seal disk or the frustoconical wall.

In the embodiment illustrated, the ring 30 extends radially outwardly of the free end 32 of the frustoconical wall 26. In other embodiments, the ring may terminate flush with the frustoconical wall. In still other embodiments, the ring 30 may merely constitute the open end 32 of the frustoconical wall.

Figure 2:
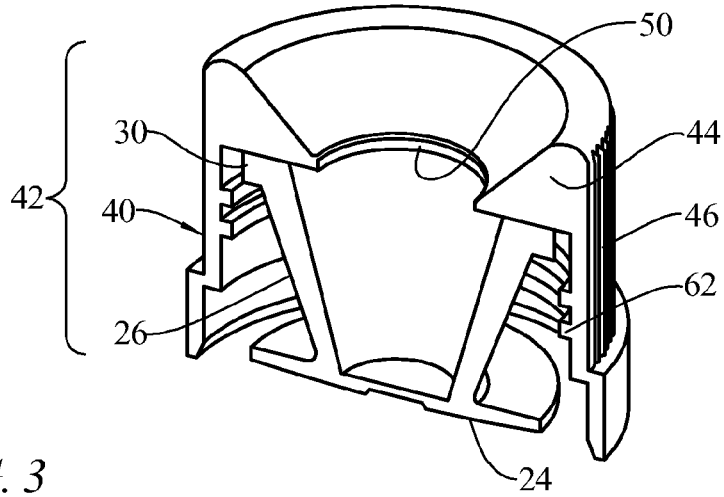
FIG. 2 is a top perspective side sectional view of a seal member and cap assembly.
Figure 3:
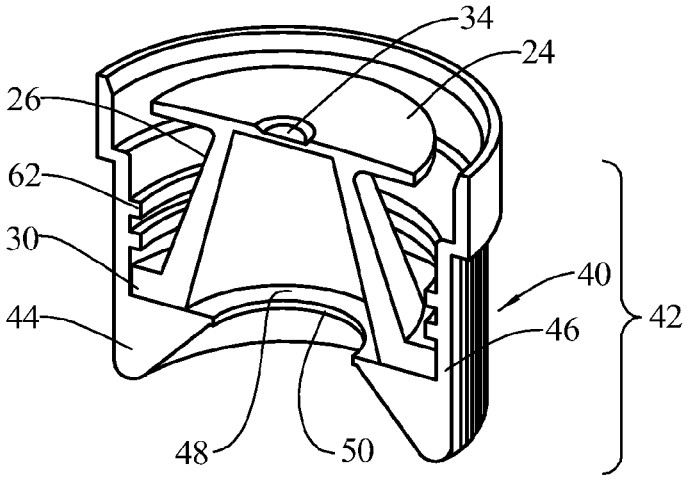
FIG. 3 is a bottom perspective side sectional view of a seal member and cap assembly.

In an embodiment of the invention, as shown in FIGS. 2-4 the seal member 20 is assembled with a cap 40, and the resulting assembly 42 is used with the bulk liquid dispensing cartridge 22. The assembly 42 includes the seal member 20 as described above and the cap 40 having an end wall 44 and a depending cylindrical skirt wall 46. The cylindrical skirt wall 46 has a first internal diameter D3 adjacent to the end wall 44, and the outer diameter D1 of the ring 30 of the seal member 20 is slightly less than the first internal diameter of the skirt wall so that the seal member can be received in the cap 40. The ring 30 is positioned in an abutting relationship with an interior surface 48 of the end wall 44 of the cap 40. The cap 40 has a central opening 50 through the end wall 44 with a diameter D4 no larger than an inner diameter D5 of the ring 30.

In an embodiment, as shown in FIGS. 2-3, the central opening 50 through the end wall 44 of the cap 40 is beveled inwardly towards the interior surface 48 of the end wall.

In an embodiment of the invention, the cap and seal member assembly 42 is used with the bulk liquid dispensing cartridge 22 having a cylindrical mouth wall 60 with an inner diameter D6 and an outer diameter D7. The cap 40 and the seal member 22 are constructed as described above, further including that the cylindrical skirt wall 46 of the cap has its internal diameter D3 sized to receive the outer diameter D7 of the cartridge mouth wall 60. This will allow the cap 40 to be received on the outside of the mouth wall 60.

The diameter D2 of the seal disk 24 is larger than the inner diameter D6 of the cartridge mouth wall 60. This causes the seal disk 24 to be deflected downwardly (as viewed in FIGS. 4 and 5) as the cap 40 is moved onto the mouth wall 60. The deflection of the seal disk 24, in combination with the frustoconical shape of the side wall 26, results in a radially inwardly directed force (arrows 61, FIG. 5) on the seal disk, in the central area 34, due to the narrow end of the frustoconical wall 26 being urged inwardly.

Figure 6:
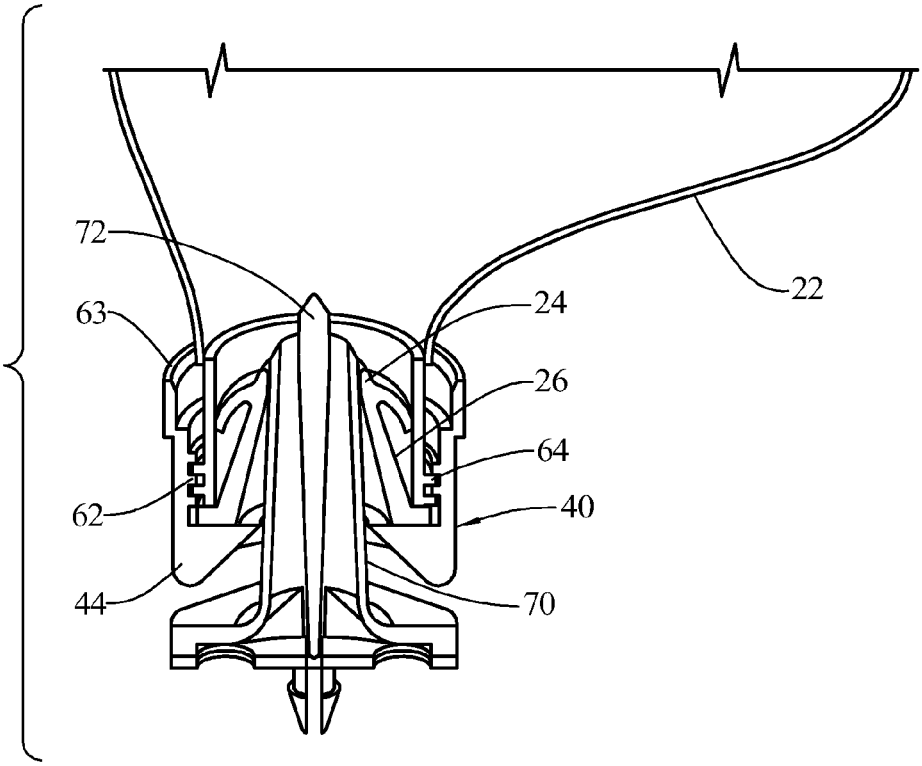
FIG. 6 is a perspective side sectional view of the seal member and cap assembly of FIG. 4 after the seal member has been punctured.

The outer diameter D1 of the ring 30 on the seal member 20 is smaller than the internal diameter D3 of the skirt wall 46, which allows the seal member to be inserted into the cap 40, and is at least equal to the outer diameter D7 of the cartridge mouth wall 60. The outer diameter D1 of the ring 30 may extend radially outwardly of the free end 32 of the frustoconical wall 26. In such an embodiment, the ring 30, as shown in FIG. 6, will be clamped between an end of the mouth wall 60 and the inside surface of the cap 40.

In an embodiment, the cap 40 includes a helical thread 62 at a second internal diameter D8 near an open end 63 of the cap to engage with a complementary helical thread 64 on the cylindrical mouth wall 60 of the cartridge 22. In this manner, the cap 40 can be securely attached to the cartridge 22, and the resiliency of the ring 30, engaged by the end of the mouth wall 60, will snuggly hold the cap on the cartridge. In other embodiments, the cap 40 might have a snap fit or other mating arrangement with the cartridge 22.

With the cap 40 held on the cartridge 22, the seal member 20, and particularly the seal disk 24, will prevent any of the contents of the cartridge from escaping, such as through the opening 50 in the cap. In order to allow the contents of the cartridge 22 to be dispensed, as shown in FIG. 6, a hollow needle 70, with a sharp puncturing probe or lance 72 is directed in through the opening 50 in the cap to engage with the central portion 34 of the seal disk 24. The bevel of the opening 50, if provided, will assist in guiding the probe 72 into the opening 50 towards the seal disk 24. The needle 70 and the probe 72 may form a portion of a docking receptacle for the cartridge 22 or may be formed at an end of a conduit used to transport the contents of the cartridge to a point of utilization.

The central area 34 of the seal disk 24 may be thinner than the thickness of a remainder of the seal disk, if necessary, to assist in the puncturing of the seal disk by the probe 72. In some embodiments, the thinning may not be necessary. The probe 72 will puncture the central area 34, and the wall of the hollow needle 70 will force open the puncture aperture to result in a fairly large opening 74 in the seal disk 24, as best seen in isolation in FIG. 7. The inwardly directed forces (arrows 61, FIG. 7) provided by the frustoconical wall 26 and the deflection of the outer portion of the seal disk 24 by the mouth wall 60, as described above, will urge the edge of the seal disk opening 74 into tight engagement with the hollow needle 70, preventing any of the contents of the cartridge 22 from leaking out between the seal disk and the needle.

When the cartridge 22 and cap 40 are removed from engagement with the hollow needle 70, the inwardly directed forces provided by the frustoconical wall 26 and the deflected seal disk 24, as well as the plastic memory of the material of the seal member 20, will constrict the opening 74 in the seal disk, essentially resealing the opening, and preventing further dispensing or leaking of the contents of the cartridge 22.

Various features of the receptacles and cartridges have been described which may be incorporated singly or in various combinations into a desired system, even though only certain combinations are described herein. The described combinations should not be viewed in a limiting way, but only as illustrative examples of particular possible combinations of features.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A seal member for a bulk liquid dispensing cartridge, comprising:

a flat circular seal disk, a frustoconical wall extending away and outwardly from an intermediate portion of the seal disk with the seal disk forming a closed end of the frustoconical wall and such that an annular portion of the seal disk extends radially outwardly beyond a junction of the seal disk and the frustoconical wall, and a ring positioned at an open end of the frustoconical wall.

2. The seal member according to claim 1, wherein the seal disk has a central area with a reduced thickness as compared to a remainder of the seal disk.

3. The seal member according to claim 1, wherein the ring has a larger outer diameter than a diameter of the seal disk.

4. The seal member according to claim 1, wherein the seal is integrally formed as one piece of a pliable material having a plastic memory.

5. The seal member according to claim 1, wherein the ring extends radially outwardly of the free end of the frustoconical wall.

6. A cap and seal member assembly for use with a bulk liquid dispensing cartridge, comprising:

a seal member having:

a flat circular seal disk, a frustoconical wall extending away and outwardly from an intermediate portion of the seal disk with the seal disk forming a closed end of the frustoconical wall and such that an annular portion of the seal disk extends radially outwardly beyond a junction of the seal disk and the frustoconical wall, a ring positioned at an open end of the frustoconical wall, a cap having an end wall and a depending cylindrical skirt wall, the cylindrical skirt wall having a first internal diameter adjacent to the end wall, the ring having an outer diameter slightly less than the first internal diameter of the skirt wall, with the ring being positioned in an abutting relationship with an interior surface of the end wall of the cap, and the cap having a central opening through the end wall with a diameter no larger than an inner diameter of the ring.

7. The cap and seal member assembly according to claim 6, wherein the central opening through the end wall of the cap is beveled.

8. The cap and seal member assembly according to claim 6, wherein the cap includes a helical thread on an interior surface of the skirt wall.

9. The cap and seal member assembly according to claim 6, wherein the seal disk has a central area with a reduced thickness as compared to a remainder of the seal disk.

10. The cap and seal member assembly according to claim 6, wherein the ring has a larger outer diameter than a diameter of the seal disk.

11. The cap and seal member assembly according to claim 6, wherein the seal is integrally formed as one piece of a pliable material having a plastic memory.

12. The cap and seal member assembly according to claim 6, wherein the ring extends radially outwardly of the free end of the frustoconical wall.

13. A cap and seal member assembly for use with a bulk liquid dispensing cartridge having a cylindrical mouth wall with an inner diameter and an outer diameter, comprising:

a cap having an end wall and a depending cylindrical skirt wall with an internal diameter sized to receive the outer diameter of the cartridge mouth wall, a seal member having:

a flat circular seal disk with a diameter larger than the inner diameter of the cartridge mouth wall causing the disk to be deflected as the cap is moved onto the mouth wall, a frustoconical wall extending away and outwardly from an intermediate portion of the seal disk with the seal disk forming a closed end of the frustoconical wall and such that an annular portion of the seal disk extends radially outwardly beyond a junction of the seal disk and the frustoconical wall, and a ring positioned at an open end of the frustoconical wall, the ring having an outer diameter less than the internal diameter of the skirt wall and at least equal to the outer diameter of the cartridge mouth wall, with the ring being positioned in an abutting relationship with an interior surface of the end wall of the cap, and the cap having a central opening through the end wall with a diameter no larger than an inner diameter of the ring wherein the deflection of the seal disk in combination with the frustoconical shape of the frustoconical wall results in a radially inwardly directed force on the seal disk.

14. The cap and seal member assembly according to claim 13, wherein the ring extends radially outwardly of a free end of the frustoconical wall.

15. The cap and seal member assembly according to claim 13, wherein the cap includes a helical thread to engage with a complementary helical thread on the cylindrical mouth wall of the cartridge.

16. The cap and seal member assembly according to claim 13, wherein the seal disk has a central area with a reduced thickness as compared to a remainder of the seal disk.

17. The cap and seal member assembly according to claim 13, wherein the ring has a larger outer diameter than a diameter of the seal disk.

18. The cap and seal member assembly according to claim 13, wherein the seal is integrally formed as one piece of a pliable material having a plastic memory.

19. The cap and seal member assembly according to claim 13, wherein the central opening through the end wall of the cap is beveled.

20. The cap and seal member assembly according to claim 13, wherein the cap includes a helical thread to engage with a complementary helical thread on the cylindrical mouth wall of the cartridge, the seal disk has a central area with a reduced thickness as compared to a remainder of the seal disk, the central opening through the end wall of the cap is beveled, and the seal is integrally formed as one piece of a pliable material having a plastic memory.

* * * * *